US006622827B1

(12) United States Patent
Disieno

(10) Patent No.: US 6,622,827 B1
(45) Date of Patent: Sep. 23, 2003

(54) ELEVATOR TAPE GUIDE WITH TAPE SLOT REDUNDANCY

(75) Inventor: Martin Disieno, Johnson, NY (US)

(73) Assignee: Anna Disieno, Johnson, NY (US)

( * ) Notice: Subject to any disclaimer, the term of this patent is extended or adjusted under 35 U.S.C. 154(b) by 0 days.

(21) Appl. No.: 10/142,584

(22) Filed: May 10, 2002

(51) Int. Cl.[7] ..... B66B 3/02
(52) U.S. Cl. ..... 187/394; 187/391
(58) Field of Search ..... 187/391, 393, 187/394, 282, 283, 409, 414

(56) References Cited

U.S. PATENT DOCUMENTS 3,889,231 A * 6/1975 Tosato et al. ..... 187/394
4,674,603 A * 6/1987 Estrella ..... 187/394
4,798,267 A * 1/1989 Foster et al. ..... 187/389
5,360,085 A * 11/1994 Yoo et al. ..... 187/406
5,594,219 A * 1/1997 Kamani et al. ..... 187/394
5,677,519 A * 10/1997 Herkel et al. ..... 187/291
5,783,783 A * 7/1998 Toutaoui et al. ..... 187/394
5,925,859 A * 7/1999 Miller et al. ..... 187/394

FOREIGN PATENT DOCUMENTS

JP 02048389 A * 2/1990 ..... B66B/5/02

* cited by examiner

*Primary Examiner*—Jonathan Salata
(74) *Attorney, Agent, or Firm*—Natter & Natter

(57) ABSTRACT

An elevator tape guide for a hoistway tape includes a mounting plate having recesses for receiving insertable plug members, the plug members each have two tape engaging slots with the slots being severally registrable with the tape for slot wear-replacement.

21 Claims, 2 Drawing Sheets

ELEVATOR TAPE GUIDE WITH TAPE SLOT REDUNDANCY

BACKGROUND OF THE INVENTION

1. Field of the Invention

This invention relates generally to elevator control systems and especially to elevator monitoring apparatus.

In particular, the device of this invention concerns an improved tape guide for use with an elevator hoistway tape.

2. Background Information

Elevator control systems, among other functions, monitor the speed and location of an elevator cab assembly within an elevator hoistway by sensing movement of the cab relative to a stationary tape vertically suspended in the hoistway. The tape is commonly provided with indicia such as a series of apertures, or magnetic elements, or light-reflective vanes. A sensor unit mounted on the elevator cab detects the indicia and generates corresponding output signals that are transmitted to an elevator controller.

Tape guides mounted on the elevator cab assembly engage opposite edges of the tape to precisely position the tape with respect to the sensor unit. The tape guides include guide slots for slidingly receiving the respective edges of the tape. The relative displacement of the tape within the guide slots, over a period of time, result in wear changes in the guide slot which effect sensing performance. This can be detected during routine maintenance of the elevator system and corrected by replacement of the tape guides. However, the elevator servicing requires temporarily disabling the elevator cab for the removal and replacement of the tape guides. This can be a time-consuming and costly procedure and an inconvenience to passengers.

Several attempts have been made to extend the useful life of tape guides including a tape guide construction having reciprocal tape slots on opposite faces of the guide. The life of the tape guide can be prolonged by removal and remounting for use of the tape slot on the reverse face of the guide. Nevertheless, after the second slot has been used, the entire tape guide must be discarded and replaced.

Another tape guide with an alternative slot arrangement is shown in U.S. Pat. No. 4,798,267 and has similar shortcomings. The use of non-abrasive material for reducing friction within a tape guide is disclosed in U.S. Pat. No. 5,925,859. The tape guide arrangement of U.S. Pat. No. 5,360,085 is intended to reduce operating noise, and the tape guide shown in U.S. Pat. No. 4,674,603 is directed to facilitating removal and repair. The aforementioned tape guides do not achieve the maintenance expediency and cost economy of the present invention.

BRIEF SUMMARY OF THE INVENTION

Briefly, the nature of this invention concerns an elevator tape guide with redundant guide slots. The tape guide includes a mounting plate adapted for attachment to an elevator cab assembly. The mounting plate accommodates a removable plug member. The plug member includes two tape guide slots with each of said slots being severally registrable with an edge of the tape as needed for wear-replacement. The plug member may be removed and replaced at the end of the useful slot life without discarding the mounting plate.

Having thus summarized the invention, it will be seen that it is a preferred object thereof to provide an elevator tape guide of the general character described herein which is not subject to the previously mentioned limitations.

A preferred object of this invention is to provide an elevator tape guide with a replaceable slot plug member for more effective serviceability and improved maintenance management.

A further preferred object to this invention is to provide an elevator tape guide having a plug member with plural tape slots for expeditious tape slot substitution.

A still further preferred object of the present invention is to provide an elevator tape guide that is practical in use, reliable in operation, relatively simple in design, and economical to manufacture.

With these ends in view, the invention finds embodiment in certain combinations of elements and arrangements of parts by which the aforementioned preferred objects and certain other objects are hereinafter attained, all as more fully described with reference to the accompanying drawings and the scope of which is more particularly indicated in the appended claims.

BRIEF DESCRIPTION OF THE DRAWINGS

In the accompany drawings, in which is shown an exemplary embodiment of the invention.

DETAILED DESCRIPTION OF THE INVENTION

With specific reference now to the figures in detail, it is stressed that the particulars shown are by way of example and for the purposes of illustrative discussion of the preferred embodiment of the present invention only and are presented in the cause of providing what is believed to be the most useful and readily understood description of the principles and conceptual aspects of the invention. In this regard, no attempt is made to show aspects of the invention in more detail than is necessary for a fundamental understanding of the invention, the description taken with the drawings make it apparent to those skilled in the art how the several forms of the invention may be embodied in practice.

Figure 1:
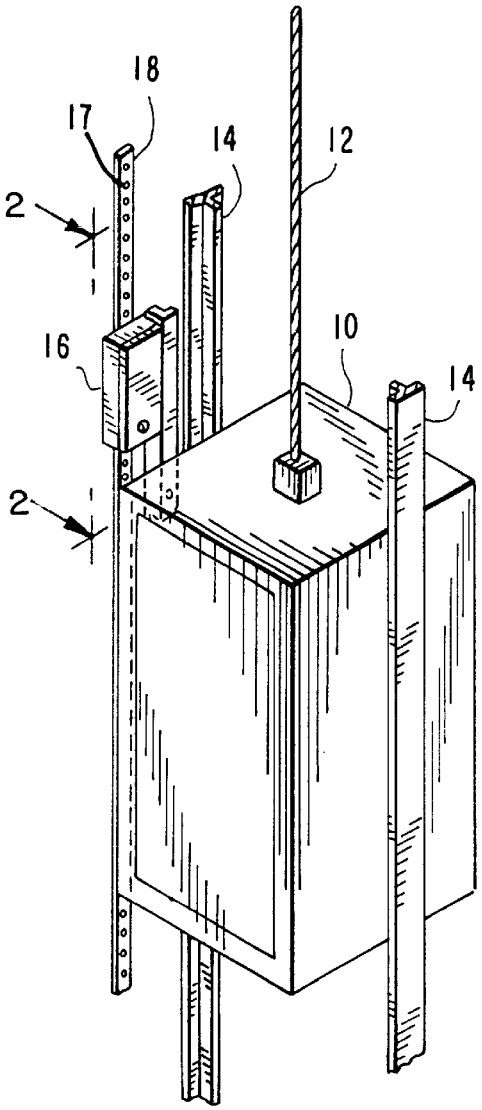
FIG. 1 is an isolated perspective view illustrating an elevator cab, a position sensor, and an elevator hoistway tape within an elevator hoistway.

Referring now in detail to FIG. 1 of the drawings, there is shown an elevator cab 10 within an elevator hoistway, also shown is a hoisting cable 12, a set of guide rails 14, a sensor unit 16, and a suspended hoistway tape 18. The hoistway tape 18 is a steel band typically about 3 inches in width by 0.020 inches in thickness. In the illustrative embodiment, a series of apertures 17 in the tape 18 provide detection indicia for use by the sensor unit 16 as the elevator cab 10 moves relative to the stationary tape 18.

Figure 2:
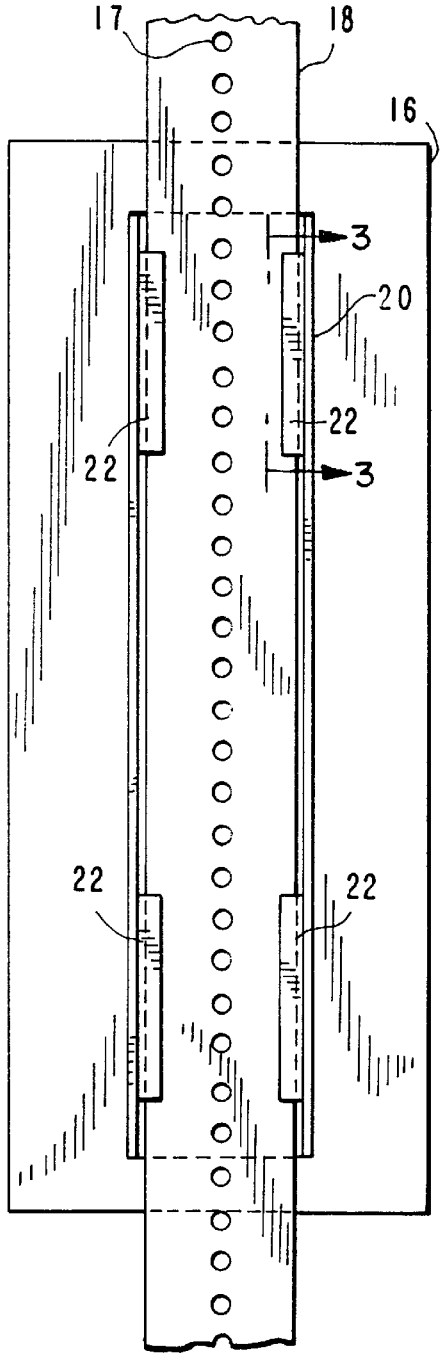
FIG. 2 is an elevational view, to an enlarged scale, taken substantially along line 2—2 of FIG. 1 showing a set of tape guides engaging the tape.

Referring now to FIG. 2, it will be seen that a bracket member 20 is affixed to the sensor unit 16 within the tape travel path. Two sets of opposed elevator tape guides 22 are mounted to the bracket member 20 typically by removable screw fasteners. The tape guides 22 are of identical construction and will be referred to in the singular with regard to this description.

Figure 3:
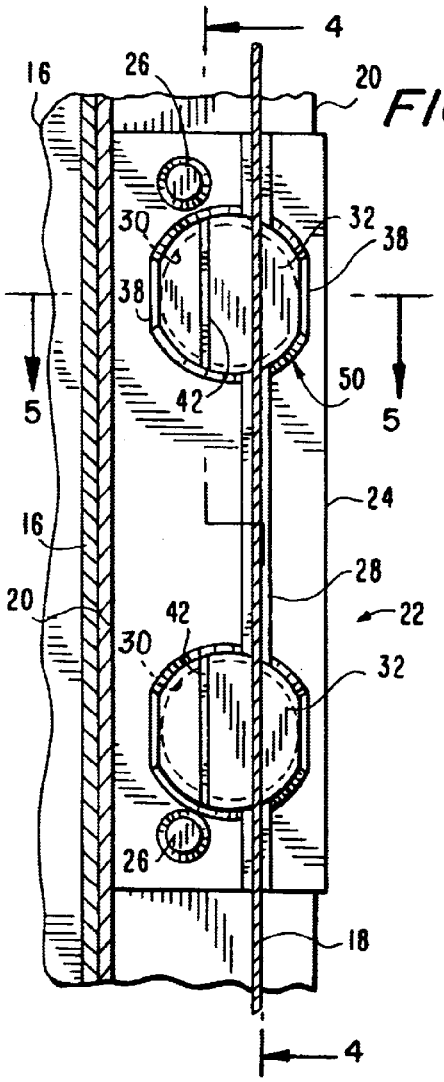
FIG. 3 is an elevational view to an enlarged scale taken along line 3—3 of FIG. 2 illustrating the tape guide and showing a set of plug members within a mounting plate and the hoistway tape received within a guide slot of the respective plug members.
Figure 4:
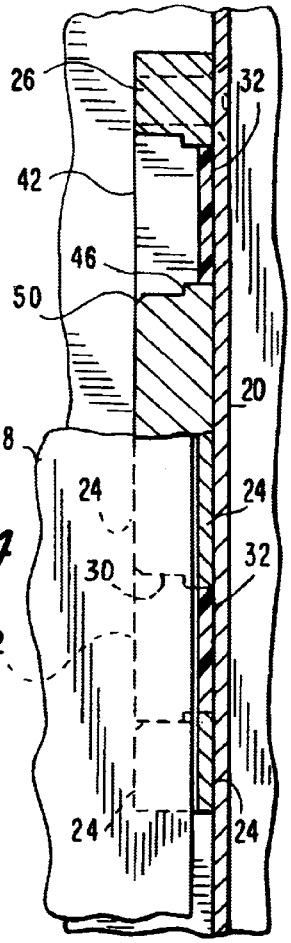
FIG. 4 is a sectional view in elevation taken along line 4—4 of FIG. 3 showing in detail the plug member accommodated within the mounting plate with the hoistway tape engaging the guide slots.

As best shown in FIG. 3, the tape guide 22 is comprised of a substantially rectangular mounting plate 24 preferably aluminum stock, having a length dimension of approximately 3.5 inches, a width dimension of approximately 1 inch and a depth dimension of approximately 0.375 inches.

The mounting plate 24 includes two threaded openings 26 for securement to the bracket member 20 by appropriate screw fasteners (not shown). The mounting plate 24 further defines a tape channel 28 extending along a longitudinal axis and corresponding to the path of travel of the hoistway tape 18. By way of example, the tape channel 28 is approximately 0.125 inches in width and extends to a depth of about 0.3 inches. It should also be noted that the tape channel 28 is not intended to provide close tolerance for the tape 18. Additionally, two recesses 30 extend transversely through the mounting plate 24. The tape channel 28 intersects with the recesses 30 as will be further discussed herein. The recesses 30 are adapted to accommodate a respective plug member 32. The plug member 32 is substantially cylindrical and defines a head section 34 and a stem section 36. The plug member 32 is typically comprised of Nylatron or similar nylon composition material having a low coefficient of friction. The diametrical dimension of the head is about 0.75 inches and the maximum diametrical dimension of the stem is about 0.65 inches. As further shown, the circumference of the head section 34 is defined by opposed chord segments 38.

Figure 5:
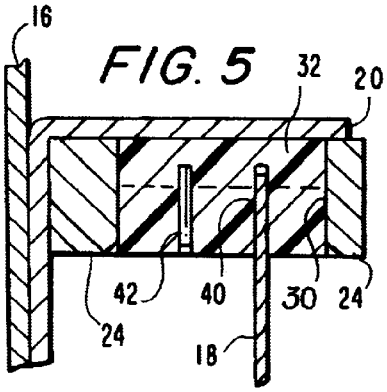
FIG. 5 is a sectional view to an enlarged scale taken substantially along line 5—5 of FIG. 3 further illustrating the tape guide slots.
Figure 6:
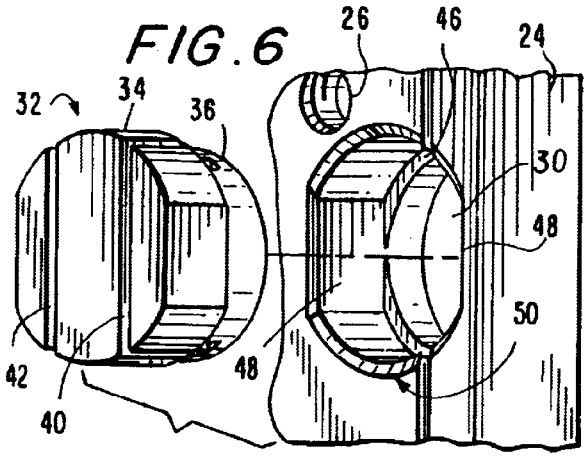
FIG. 6 is an exploded perspective view, to an enlarged scale, showing the plug member removed from recess in the mounting plate.

Additionally, a set of tape slots 40, 42 extend transversely across the surface of the head section 34, through the head section 34 and partially through the stem section 36 as shown in FIG. 5. The tape slots 40, 42 are parallel to each other and to the chord segments 38.

The recess 30 is defined by a transverse bore extending through the mounting plate 24. The bore includes an internal wall having a necked-down portion 44 which defines a shoulder 46 being adapted for abutting contact with the head section 34 when the plug member 32 is seated in the recess 30. It should further be noted that the recess 30 also contains a linear wall portion 48 in correspondence with the chord segment 38.

When the plug 32 is snugly-seated within the recess 30, the directionally interfitting relationship between the linear wall 46 and chord section 38 provide for self-alignment of one of the tape slots 40, 42 with the tape channel 28 (See FIG. 3). Furthermore, the respective surface of the plug member 32 and the mounting plate 24 will be coincidental.

The tape slots 40, 42 can typically have a width dimension within the range of 0.025 inches to 0.040 inches and a length dimension of about 0.7 inches. The tape channel 28, can typically have a width dimension of approximately 0.100 inches to 0.150 inches.

In order to facilitate the insertion of the plug member 32 into the recess 30, a margin 50 of the recess 30 at the intersection with an upper surface of the mounting plate 24 is chamfered; typically 0.040 inches by 45°.

With regard to use of tape guide 22, if, for example, the tape slot 40 requires replacement due to wear changes, the plug member 32 can be removed by unscrewing the mounting plate 24 from the bracket member 20. A pressure is applied on the stem section 36 in the direction of the head section 34 to release the plug member 32. The plug member 32 can then be repositioned such that the alternative tape slot 42 is aligned with the tape channel 28 and the plug member 32 is then reinserted in the recess 30 for snug-fitted seating. As previously discussed, the cooperation between the linear wall 48 and the chord segment 38 provide for self-alignment of the plug member 32 during reinsertion. When the tape slot 42 reaches the end of its useful life, the plug member 32 may be removed and replaced by a substitute plug member without discarding the mounting plate 24.

It should be further apparent that the recess 30 and the plug member 32 can have different slot configurations and that the plug member 32 can, for example, be designed for multiple-positioned seating with alternative tape slot patterns. In this regard, a circular plug member can be adapted with guide slots oriented in al multiple diametrical pattern requiring angular displacement for registering a selective tape slot.

The present embodiment however, is preferred in that it simplifies the installation requirements for an elevator mechanic and thus eliminates potential errors. Although the mounting plate: 24 must be unfastened to remove and/or replace the plug member 32, it is within the scope of this invention to provide a tool for removing the plug member 32 without having to unfasten the plate 24.

It should thus be seen that there is provided an elevator tape guide which achieves the various preferred objects of this invention and which is well adapted to meet conditions of practical use. Since other various possible embodiments might be made of the present invention or modifications might be made through the exemplary embodiment set forth above, it is to be understood that all materials shown and described in the accompanying drawings are to be interpreted as a illustrative and not in a limiting sense.

Having thus described the invention, there is claimed as new and desired to be secured by Letters Patent:

1. An elevator tape guide for use with an elevator hoistway tape, said tape guide comprising a mounting plate, said mounting plate defining at least one recess in a surface of the mounting plate for accommodating a plug member, said plug member defining at least one tape slot, said tape slot being registrable with an edge of said elevator hoistway tape for slidingly accommodating the tape during relative displacement.

2. An elevator tape guide as claimed in claim 1 wherein the surface of the mounting plate includes a tape channel defining a path of travel for the hoistway tape.

3. An elevator tape guide as claimed in claim 2 wherein the tape channel extends along a longitudinal axis of the mounting plate.

4. An elevator tape guide as claimed in claim 3 wherein the tape channel intersects with the recess.

5. An elevator tape guide as claimed in claim 1 wherein the plug member defines a surface that is coincidental with the surface of the mounting plate when the plug member is seated within the recess.

6. An elevator tape guide as claimed in claim 5 wherein the tape slot is self-aligning with the tape channel when seated within the recess.

7. An elevator tape guide as claimed in claim 1 wherein the plug member defines at least one alternative tape slot.

8. An elevator tape guide as claimed in claim 7 wherein the plug member is selectively repositionable for accessing the alternative tape slot.

9. An elevator tape guide as claimed in claim 1 wherein the plug member is removable for wear-replacement.

10. An elevator tape guide as claimed in claim 1 wherein the mounting plate defines two spaced-apart recesses for accommodating respective plug members.

11. An elevator tape guide as claimed in claim 1 wherein the plug member contains two parallel tape slots.

12. An elevator tape guide as claimed in claim 1 wherein the plug member is substantially cylindrical and defines a head section having a diametrical dimension and a stem section having another diametrical dimension.

13. An elevator tape guide as claimed in claim 12 wherein the head section defines a circumference having a chord segment.

14. An elevator tape guide as claimed in claim 13 wherein the tape slot is parallel to the chord segment.

15. An elevator tape guide as claimed in claimed 13 wherein the recess defines a linear wall in correspondence with the chord segment for self-alignment of the tape slot with the tape channel.

16. An elevator tape guide as claimed in claim 1 wherein the recess defines a bore extending transversely through the mounting plate.

17. An elevator tape guide as claimed in claim 16 wherein the bore includes an internal wall having a necked-down portion that defines a shoulder, said shoulder being adapted for abutting contact with the head section when the plug member is seated.

18. An elevator tape guide as claimed in claim 12 wherein the tape slot extends transversely across and at least partially through the head section.

19. An elevator tape guide as claimed in claim 1 wherein a margin of the recess at the intersection with the surface of the mounting plate is chamfered to facilitate insertion of the plug member.

20. An elevator tape guide for use with an elevator hoistway tape, said tape guide comprising a mounting plate, the mounting plate being adapted for removably seating a plug member, said plug member defining plural tape slots, said plug member further being repositionable for registering a selected tape slot with an edge of the hoistway tape for slidingly accommodating the tape.

21. An elevator tape guide for use with an elevator hoistway tape comprising a mounting plate, said plate being secured for relative displacement with respect to an elevator hoistway tape, said mounting plate further defining a surface in confronting relationship with an edge of the hoistway tape, said surface including at least one recess, a plug member for accommodation within said recess, said plug member defining a plug surface having at least two slots, said slots being severally registrable with the hoistway tape for slideably accommodating the edge of the hoistway tape.

* * * * *